US008672588B2

(12) United States Patent
Vogel et al.

(10) Patent No.: US 8,672,588 B2
(45) Date of Patent: Mar. 18, 2014

(54) UNOBSTRUCTED LOW PRESSURE OUTLET AND SCREEN GRID FOR A HIGH PRESSURE FEEDER

(75) Inventors: Keith Vogel, Queensbury, NY (US); Carl Luhrmann, Glens Falls, NY (US)

(73) Assignee: Andritz Inc., Glens Falls, NY (US)

( * ) Notice: Subject to any disclaimer, the term of this patent is extended or adjusted under 35 U.S.C. 154(b) by 699 days.

(21) Appl. No.: 12/756,387

(22) Filed: Apr. 8, 2010

(65) Prior Publication Data

US 2010/0266351 A1 Oct. 21, 2010

Related U.S. Application Data

(60) Provisional application No. 61/169,378, filed on Apr. 15, 2009.

(51) Int. Cl.
*B65G 53/08* (2006.01)

(52) U.S. Cl.
USPC ..... 406/64

(58) Field of Classification Search
USPC ..... 406/64, 181, 182
See application file for complete search history.

(56) References Cited

U.S. PATENT DOCUMENTS 3,411,986 A 11/1968 Buchberger et al.
3,633,797 A * 1/1972 Graff ..... 222/636
4,033,811 A * 7/1977 Gloersen ..... 162/17
4,078,964 A * 3/1978 Gloersen ..... 162/17
4,107,843 A 8/1978 Spino et al.
4,187,043 A * 2/1980 Kindersley ..... 406/105
4,338,049 A * 7/1982 Richter et al. ..... 406/63
4,372,338 A * 2/1983 Efferson ..... 137/240
4,372,711 A * 2/1983 Richter et al. ..... 406/63
4,415,296 A * 11/1983 Funk ..... 406/19
4,508,473 A * 4/1985 Richter et al. ..... 406/64
4,516,887 A * 5/1985 Richter et al. ..... 406/63
4,555,254 A * 11/1985 Fisher ..... 55/345
4,743,338 A * 5/1988 Prough ..... 162/25
4,863,317 A * 9/1989 Boyle ..... 406/109
5,236,285 A 8/1993 Prough
5,236,286 A * 8/1993 Prough ..... 406/52
5,443,162 A * 8/1995 Sherman ..... 209/274
6,120,646 A 9/2000 Snekkenes et al.

(Continued)

FOREIGN PATENT DOCUMENTS

WO 94/21855 A1 9/1994
WO 99/42653 A1 8/1999

*Primary Examiner* — Joseph Dillon, Jr.
(74) *Attorney, Agent, or Firm* — Nixon & Vanderhye P.C.

(57) ABSTRACT

A rotary high pressure feeder for feeding cellulosic fibrous material including: a rotor rotatable about an axis and comprising at least one pocket having a conduit extending through the rotor in a direction perpendicular to the axis and having end openings at opposite ends of the pocket, wherein each of said end openings of each pocket functions as both an inlet and outlet depending upon an angular position of the rotor within a housing; the housing encloses said rotor and said housing includes a low pressure inlet port and a low pressure outlet port radially opposed to the low pressure inlet port, and a high pressure inlet port and a high pressure outlet port aligned horizontally, wherein the ports are arranged on the housing for registry with the end openings of at least one pocket, and a screen grid seated in or adjacent to the low pressure outlet port, wherein the screen grid includes an array of screen slots and bars forming a uniform pattern of slots and bars extending without interruption across an entirety of the low pressure outlet port.

18 Claims, 7 Drawing Sheets

(56) References Cited

U.S. PATENT DOCUMENTS

| | | | | |
|---|---|---|---|---|
| 6,216,877 | B1 * | 4/2001 | Lindstrom | 209/397 |
| 6,368,453 | B1 * | 4/2002 | Kettunen et al. | 162/52 |
| 6,468,006 | B1 | 10/2002 | Prough | |
| 6,616,384 | B2 | 9/2003 | Prough | |
| 6,641,336 | B1 * | 11/2003 | Bolles | 406/63 |
| 6,669,410 | B2 | 12/2003 | Prough | |
| 6,986,625 | B2 * | 1/2006 | Witheridge | 406/85 |
| 7,350,674 | B2 * | 4/2008 | Hoglund | 222/368 |
| 7,459,058 | B2 * | 12/2008 | Snekkenes | 162/17 |
| 8,025,760 | B2 * | 9/2011 | Hernesniemi et al. | 162/52 |
| 8,377,261 | B2 * | 2/2013 | Bengtsson et al. | 162/237 |
| 2002/0026991 | A1 * | 3/2002 | Stromberg et al. | 162/19 |
| 2002/0059991 | A1 * | 5/2002 | Barrett et al. | 162/17 |
| 2002/0176752 | A1 * | 11/2002 | Prough | 406/63 |
| 2003/0089466 | A1 | 5/2003 | Kettunen et al. | |
| 2003/0102093 | A1 * | 6/2003 | Stromberg | 162/52 |
| 2003/0113171 | A1 * | 6/2003 | Prough | 406/63 |
| 2003/0209335 | A1 * | 11/2003 | Henricson et al. | 162/37 |
| 2003/0215293 | A1 * | 11/2003 | Prough | 406/63 |
| 2003/0231933 | A1 * | 12/2003 | Prough | 406/63 |
| 2006/0037723 | A1 * | 2/2006 | Gustavsson et al. | 162/52 |
| 2009/0090477 | A1 | 4/2009 | Hernesniemi et al. | |
| 2009/0142147 | A1 * | 6/2009 | Pope et al. | 406/51 |
| 2012/0037328 | A1 * | 2/2012 | Bengtsson et al. | 162/232 |
| 2013/0098569 | A1 * | 4/2013 | van Lee et al. | 162/19 |

* cited by examiner

UNOBSTRUCTED LOW PRESSURE OUTLET AND SCREEN GRID FOR A HIGH PRESSURE FEEDER

RELATED APPLICATION

This application claims the benefit of U.S. Provisional Patent Application Ser. No. 61/169,378 filed on Apr. 15, 2009, the entirety of which is incorporated by reference.

BACKGROUND OF THE INVENTION

The present invention relates to high pressure feeders (HPF) typically used to pressurize slurries of comminuted cellulosic material, such as wood chips. The present invention particularly relates to screens that retain cellulosic material in the rotor of the HPF and allow liquid to be discharged through a low pressure outlet of the HPF.

High pressure feeders are typically included in chip feed systems that deliver a high pressure slurry of wood chips to a pressurized digester vessel, such as used in Kraft pulping. HPFs are described in U.S. Pat. Nos. 4,107,843; 6,120,646; 5,236,285, 6,468,006 and 6,616,384, and in published international patent applications WO 94/21855 and WO 99/42653.

HPFs typically have a rotor with four through passages that fill and empty with cellulosic material and liquid as the rotor turns in a housing. HPFs typically have a low pressure outlet through which passes liquor separated from the slurry of cellulosic material.

To prevent the loss of cellulosic material, a screen grid typically covers the low pressure outlet. The screen grid passes low pressure liquor through to the low pressure outlet and blocks cellulosic material from exiting through the low pressure outlet. In conventional HPFs, the screen grid has a narrow solid section in the center that is aligned with a divider bar in the casing of the HPF. The center-section of the screen grid abuts the outlet divider bar in the middle of the low pressure outlet of the HPF housing and below the screen grid. The divider bar is a narrow support wall extending across the center of the low pressure outlet.

The divider bar and narrow solid section of the screen grid are generally aligned with a center solid circumferential portion of the rotor of the HPF. This alignment minimizes the flow obstruction caused by the divider bar and narrow solid section. The alignment between the outlets in the rotor and the screen grid and the divider wall changes as the rotor is moved a relatively short distance, e.g., 5 inches (127 millimeters (mm), axially with respect to the liner and casing of the HPF. The rotor is periodically moved to compensate for wear on the surfaces of the rotor and the liner. Moving the rotor axially changes the alignment between the outlets in the rotor and the center solid portion of the screen grid and the divider wall. As the alignment changes, the center solid portion of the screen grid and the divider wall may become misaligned with the center of the rotor and thereby obstruct the flow of liquor passing through the low pressure outlet of the HPF.

Conventional HPFs have dual screen grids with slots that do not extend continuously over the entire area of the screen grid exposed to the ports in the rotor and the low pressure outlet in the casing. Because the region of slots is not continuous, the screen grid has solid sections that obstruct the low pressure flow of liquor from the HPF. The rotor is obstructed specifically near the outlet divider bar and the drive end of the housing. The divider bar and narrow solid section of the screen grid obstruct the flow of liquor through the outlets in the rotor and the low pressure outlet in the casing of the HPF.

The obstruction of the flow of liquor to the low pressure outlet reduces the efficiency and capacity of the HPF.

BRIEF DESCRIPTION OF THE INVENTION

An unobstructed flow of liquor to the low pressure outlet would allow for liquor to more easily flow through and out of the rotor. Allowing the liquor to flow through and out of the rotor without obstruction enhances the flow of wood chips through the HPF and to the high pressure outlet of the HPF. An unobstructed flow of liquor through the low pressure outlet would lower the pressure in the flow passing through the rotor while the rotor is aligned with the low pressure inlet to the HPF. An unobstructed flow of liquor through the low pressure outlet would increase the amount of chips that fill the rotor as the low pressure slurry of chips and liquor enters the HPF and the rotor.

There is a long felt need to improve the efficiency and capacity of HPFs. Obstructions to the low pressure outlet flow in a HPF tend to reduce the capacity and efficiency of a HPF. Increasing the capacity of HPFs allows for greater amounts of wood chips to flow through and be pressurized by the HPF. Reducing the obstructions to the low pressure outlet tends to increase the efficiency of the HPF by increasing the capacity of the HPF without requiring an increase in power applied to drive the HPF.

The slots in the screen grid have been increased to form a large single continuous slotted area in the screen grid which corresponds to the entire area of the low pressure outlet and to the areas of the ports in the rotor. The portion of casing for the drive coupling of the rotor may be decreased in size, e.g. by one inch (25 mm), to allow for an expansion of the open area of the low pressure outlet in the casing and allow for a larger slotted surface area of the screen grid. The center bar in the low pressure outlet of the liner may be removed. The expanded outlet of the casing and the screen grid slotted surface allow for an increase flow of low pressure liquid through the outlets in the pocketed rotor and out of the HPF. The fluid flow through the slots contributes to the increased efficiency of the screen grid.

In addition, the outlet divider bar in the low pressure outlet may be shortened to avoid abutting against the screen grid. A gap formed between the inner end of the divider bar and the screen grid allows the liquid to flow through and out of the center region of the screen grid.

Further, by increasing the slot opening width to between 8 millimeters (mm) to 25 mm in the screen grid and increasing the area of the slots region in the screen grid, the capacity and efficiency of the flow of liquid through the screen grid is increased.

A high pressure transfer device is disclosed comprising: a pocketed rotor containing a plurality of through flow pockets, said rotor rotatable about an axis of rotation and said pockets having opposite end openings which function as both inlets and outlets depending upon an angular position of the rotor within the device, and said pockets are provided in at least first and second sets; a housing enclosing said rotor, said housing having a low pressure inlet port aligned with a low pressure outlet port, and a high pressure inlet port aligned with a high pressure outlet port, wherein said ports are arranged for registry with the inlets to and outlets from said through going pockets and said rotor being mounted in said housing for rotation with respect to said ports about said given axis of rotation, and a screen grid seated in or adjacent to the low pressure outlet port wherein the screen grid has an array of screen slots and bars wherein a regular pattern of the slots and bars extends across an entirety of the low pressure outlet port.

A rotary high pressure feeder for processing cellulosic fibrous material comprising: a rotor rotatable about an axis and comprising at least one pocket comprising a conduit extending through the rotor in a direction perpendicular to the axis and having end openings at opposite ends of the pocket, wherein each of said end openings of each pocket functions as both an inlet and outlet depending upon an angular position of the rotor within a housing; the housing encloses said rotor and said housing includes a low pressure inlet port adapted to receive a low pressure slurry of the cellulosic fibrous material and a liquid, and a low pressure outlet port aligned vertically with the low pressure inlet port and adapted to discharge low pressure liquid extracted from the low pressure slurry passing through the low pressure inlet, and a high pressure inlet port adapted to receive a liquid flow under high pressure, and a high pressure outlet port aligned horizontally with the high pressure inlet port and adapted to discharge under high pressure the cellulosic fibrous material which passed through the low pressure inlet, wherein the ports are arranged on the housing for registry with the end openings of at least one pocket, and a screen grid seated in or adjacent to the low pressure outlet port, wherein the screen grid includes an array of screen slots and bars to allow passage of the liquid and block passage of the cellulosic fibrous material, wherein the array forms a uniform pattern of slots and bars extending without interruption across an entirety of the low pressure outlet port.

A rotary high pressure feeder for processing cellulosic fibrous material comprising: a rotor rotatable about an axis and comprising at least one pocket comprising a conduit extending through the rotor in a direction perpendicular to the axis and having end openings at opposite ends of the pocket, wherein each of said end openings of each pocket functions as both an inlet and outlet depending upon an angular position of the rotor within a housing; the housing encloses said rotor and said housing includes a low pressure inlet port adapted to receive a low pressure slurry of the cellulosic fibrous material and a liquid, and a low pressure outlet port aligned vertically with the low pressure inlet port and adapted to discharge low pressure liquid extracted from the low pressure slurry passing through the low pressure inlet, and a high pressure inlet port adapted to receive a liquid flow under high pressure, and a high pressure outlet port aligned horizontally with the high pressure inlet port and adapted to discharge under high pressure the cellulosic fibrous material which passed through the low pressure inlet, wherein the ports are arranged on the housing for registry with the end openings of at least one pocket; a screen grid seated in or adjacent to the low pressure outlet port, wherein the screen grid includes an array of screen slots and bars to allow passage of the liquid and block passage of the cellulosic fibrous material, and a gap between the screen grid and an edge of a divider wall in the housing and traversing the low pressure outlet port, wherein liquid flowing through the slots passes through the gap.

DETAILED DESCRIPTION OF THE INVENTION

Figure 2:
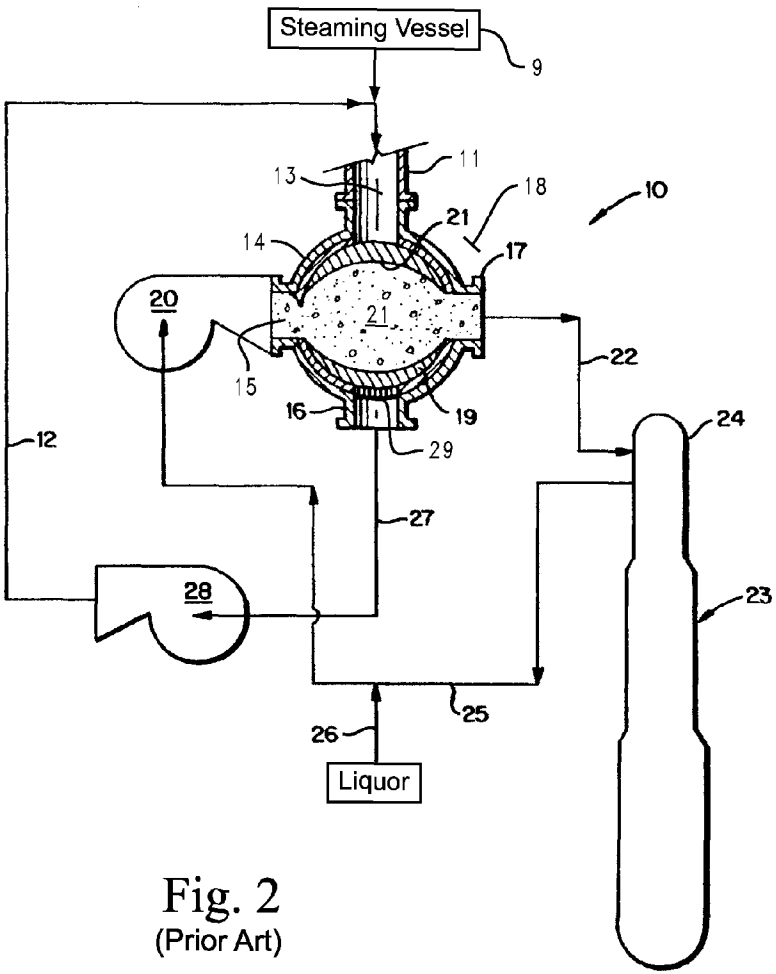
Fig. 2 (Prior Art)
FIGS. 1 and 2 are schematic views of a conventional high pressure feeder (HPF) in a feed system for a digester vessel.
Figure 1:
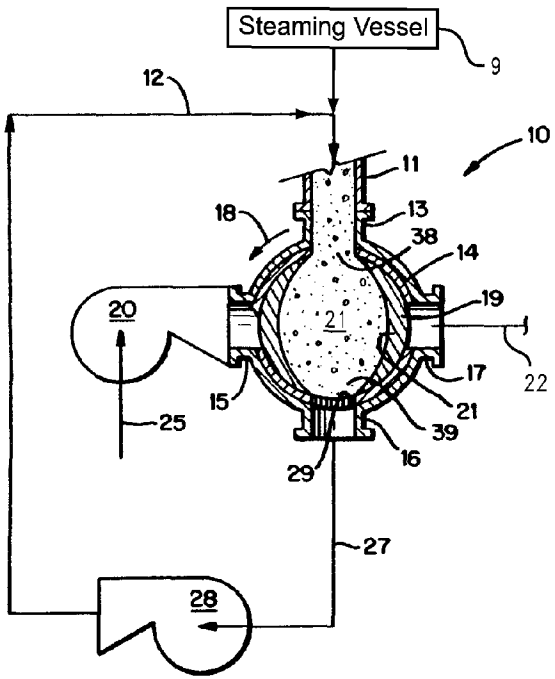
Fig. 1 (Prior Art)

FIGS. 1 and 2 schematically illustrate the operation of a high pressure transfer device, which is also referred to as a high pressure feeder (HPF) 10. As is conventional, the HPF 10 is connected to a chip chute 11, which is supplied with steamed wood chips (or other cellulosic material) from a conventional steaming vessel 9, the chips are slurried with liquid (liquor) from a liquid supply conduit 12. The chute 11 is connected to a first port (low pressure inlet) 13 of a housing (casing) of the HPF 10. The housing also has a second port (high pressure inlet) 15, a third port (low pressure outlet) 16, and a fourth port (high pressure outlet) 17. These ports 13, 15, 16 and 17 are disposed around the casing 14 at intervals of approximately 90 degrees. A pocketed rotor 19 rotates (see direction of rotation 18) within the housing 14.

The rotor 19 typically has four pockets 21 that each form a flow passage extending through the rotor in a direction perpendicular to the axis of rotation of the rotor. The rotational axis is perpendicular to the plane of FIGS. 1 and 2. The rotor rotates continuously to alternatively align the pockets with ports 1 and 3 (which are in a vertical alignment) and then with ports 2 and 4 (which are in horizontal alignment). FIG. 1 shows a pocket 21 of the rotor aligned vertically with the first and third ports, which form a low pressure passage to allow wood chips and liquor from the chip tube 11 to enter and fill the pocket 21 through the low pressure inlet (first port) 13 and for liquor to simultaneously flow out the low pressure outlet (third port) 16.

FIG. 2 shows the pocket 21 aligned horizontally with the high pressure inlet (second port) 15 and a high pressure outlet (fourth port) 17. During each quarter turn of the rotor, the pockets 21 are alternatively aligned with the low pressure inlet and outlet of the housing and then with the high pressure inlet and outlet. When aligned with the low pressure inlet and outlet 13, 16, a chip slurry fills the pocket 21 and liquid from the slurry drains through the outlet port 16. As the pocket turns with the rotor, the chips are trapped in the pocket until the pocket is aligned with the high pressure inlet and outlet 15, 17, at which point high pressure liquid flows through the inlet 15 and flushes the chips and liquid to a high pressure conduit 22 connected to the high pressure outlet 17.

Connected to the second port 15 (high pressure inlet) is a high pressure pump 20 or other source of high pressure liquid (liquor). As illustrated in FIG. 2, the pump 20 provides liquid under high pressure to the second port 15 which, when the pocket 21 is horizontal, flushes the wood chips or other cellulosic fibrous material within the pocket 21 out under high pressure through the fourth port 17 (high pressure outlet) into the circulation, high pressure conduit 22 associated with a continuous digester vessel 23. The high pressure conduit feeds the slurried pressurized chips under above-atmospheric pressure to a top inlet 24 of the digester vessel 23. At the top inlet 24, a conventional solids and liquid separator is provided which returns some of the liquid via conduit 25 that may direct some or all of the liquid to the inlet to the pump 20. The liquid in conduits 22, 25 typically is white liquor and may include steam condensate and sometimes black liquor, and which may be supplemented with make up liquor conduit 26. For non-kraft situations, the liquid in lines 22, 25 could be water, solvent pulping liquid, etc.

Connected to the third port 16 (low pressure outlet), and providing a suction thereto, is a low pressure discharge conduit 27 connected to a low pressure pump 28, the pump 28 in turn being connected to the conduit 12 to supply slurrying liquid to the chip chute 11.

A conventional screen grid 29 is mounted within the housing 14 at the third port 13. As seen in FIG. 1, the screen grid 29 allows liquid under a low pressure, e.g., atmospheric pressure (or slightly above atmospheric pressure due to the chip tube) to pass into the conduit under the influence of the suction of pump 28 and gravity. The screen grid prevents chips or other cellulosic fibrous material from passing through the third port 13. The screen grid ensures that chips or other cellulosic fibrous material remain in and fills the pocket 21 of the rotor 19, while the pocket is vertically aligned with the first and third ports.

Figure 3:
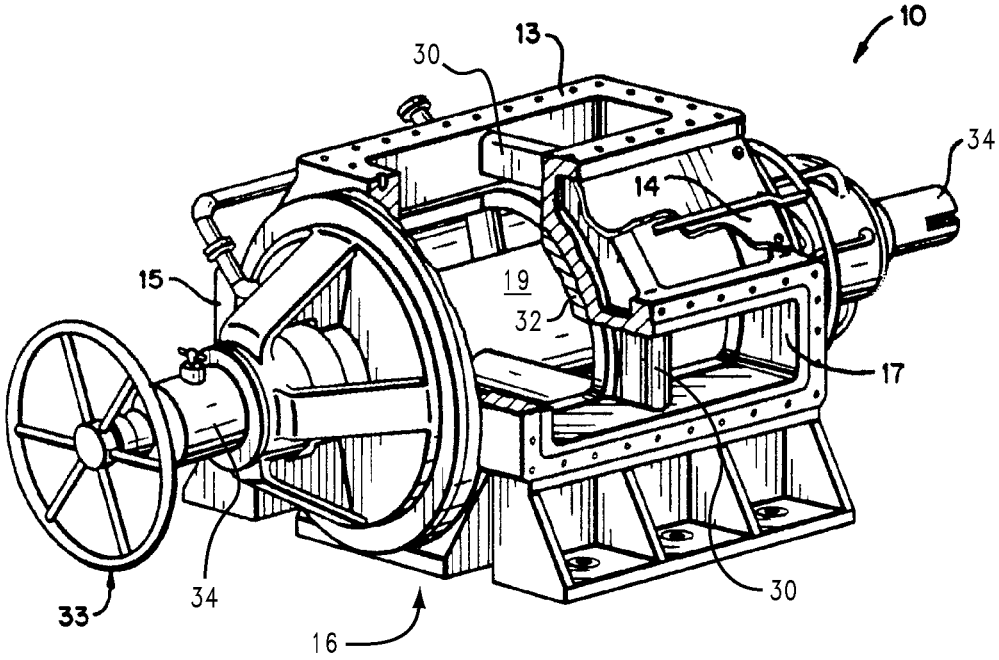
Fig. 3 (Prior Art)
FIG. 3 is a perspective view of a conventional high pressure feeder.

FIG. 3 is a perspective view of a conventional high pressure feeder (HPF) 10. The ports 13, 15, 16 and 17 are provided in the casing 14 of the HPF. Each port is generally rectangular in shape, but may have a shape adapted to accommodate the flow into or out of the rotor and to a conduit connected to the inlet. The elongated rectangular ports (see 13, 17 in FIG. 3) are aligned with the four pockets of the rotor 19. A divider wall 30 is centered in each of the ports 13, 15, 16 and 17 and is preferably aligned between the pockets of the rotor to avoid obstructing flow through the pockets. The divider walls 30 is a structural support for ports of the casing. An inner end of the divider wall 30 is adjacent a housing liner 32 or an inner wall of the casing 14.

The rotor 19 is attached to shafts 34 coaxial to the rotational axis of the rotor. The shafts are supported by bearings in the casing. A motor is coupled to one of the shafts to rotationally drive the rotor. The shafts allow for limited axial adjustment of the rotor within the casing.

An adjustment device (represented by hand turn wheel 33) moves the shafts and rotor axially with respect to the casing. Typically, the rotor is moved axially in the casing to adjust the clearance between the rotor and the liner or inner wall of the casing. The rotor and liner/inner wall of the casing may each have a slight taper along their length to their otherwise cylindrical shape. Because of the taper in the rotor and liner/inner wall, moving the rotor axially changes the clearance between the rotor and liner/inner wall. The clearance may be adjusted to compensate for wear of the rotor, liner and inner wall.

Figure 4:
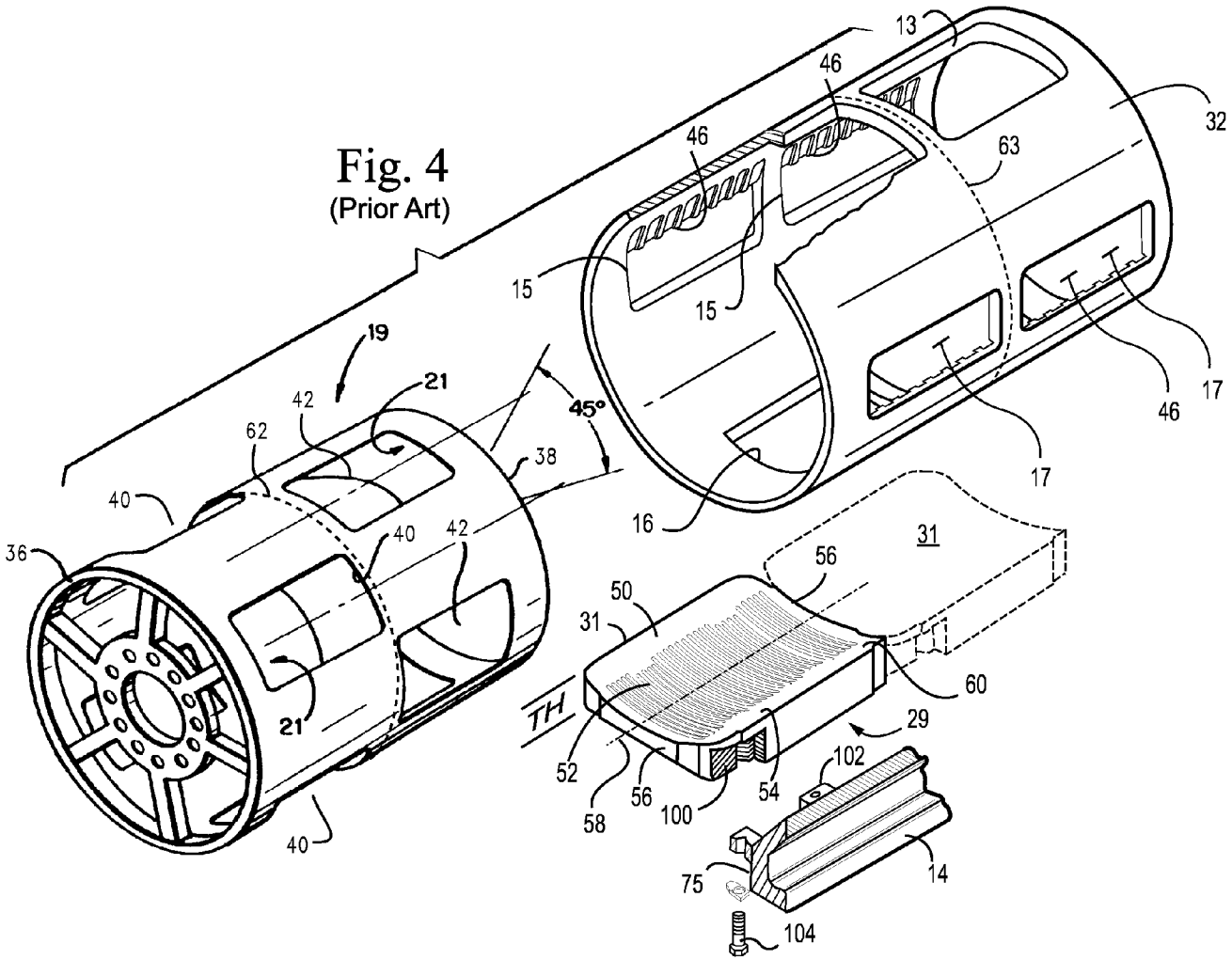
Fig. 4 (Prior Art)
FIG. 4 is a perspective view of the rotor, liner and screen grid of the conventional high pressure feeder shown in FIGS. 1 to 3.

FIG. 4 is an exploded view of the rotor 19, housing liner 32 and a conventional screen grid 29. The rotor is tapered from a first end 36 to the second end 38. The rotor is seated in and rotates with respect to the liner. The liner 32 is tapered in a corresponding manner to the rotor. The rotor 19 includes one or more (e.g. four) diametrically through-going pockets 21.

The pockets 21 each form a flow passage extending through the rotor in a direction transverse to the rotational axis. Each pocket has ports 40, 42 that alternatively allow flow into and out of the pocket. Each pocket 21 has a pair of ports 40 or 42 that are aligned along a flow passage extending perpendicular to the rotor axis. The ports 40 in the left-hand side of the rotor are provided for the pair of pockets 21 in the left hand side of the rotor. The ports 42 are provided in the rotor for the pair of pockets 21 in the right-hand side of the rotor.

As the rotor turns in the liner, the ports 40, 42 of the pockets move into and out of alignment with the openings 46 in the liner. Each of the openings 46 in the liner correspond to and is aligned with one of the ports 13, 15, 16 and 17 in the HPF. A center circumferential section 63 of the liner is conventionally solid. This center section 63 of the liner is aligned with the mid-section of the screen grid 60 and is generally aligned with the center circumferential section 62 of the rotor.

The conventional screen grid 29 is typically two screen grid sections 31 seated adjacent each other in the low pressure outlet of the casing. Each screen grid section includes an integral metal body, e.g., cast metal, having a frame 50 and a plurality of bars 52. The frame is defined by opposite sides 54 arranged generally parallel to the rotor axis, and opposite sides 56 arranged perpendicular to the rotor axis. The bars 52 may be concave to conform to the outer surface of the rotor and have a lower region along mid-line 58.

Slots are formed between the bars and are parallel to the bars. The width of the slots is typically about 8 millimeters (mm). The slots are sufficiently narrow to block the passage of wood chips and allow the passage of liquor out of the pocket 21.

A center portion 60 of the screen grid 29 is solid and has an outer surface that provides an abutment to the divider wall 30 in the outlet port 30. The screen grid extends substantially the length of the rotor and the center portion 60 is generally aligned with a circumferential region 62 of the rotor between the ports 40, 42 in the left-hand and right-hand sides of the rotor.

The thickness (TH) of the screen grid may taper from one end 56 to the other end 56. The taper conforms to the taper of the liner and rotor.

The screen grid 31 has a recess 100 that seats on prongs 102 extending inwardly of an inside wall 75 of the low pressure outlet of the HPF casing 14. Fastener bolts 104 secure the screen grid 31 to the prongs 102 and the casing.

Figure 5A:
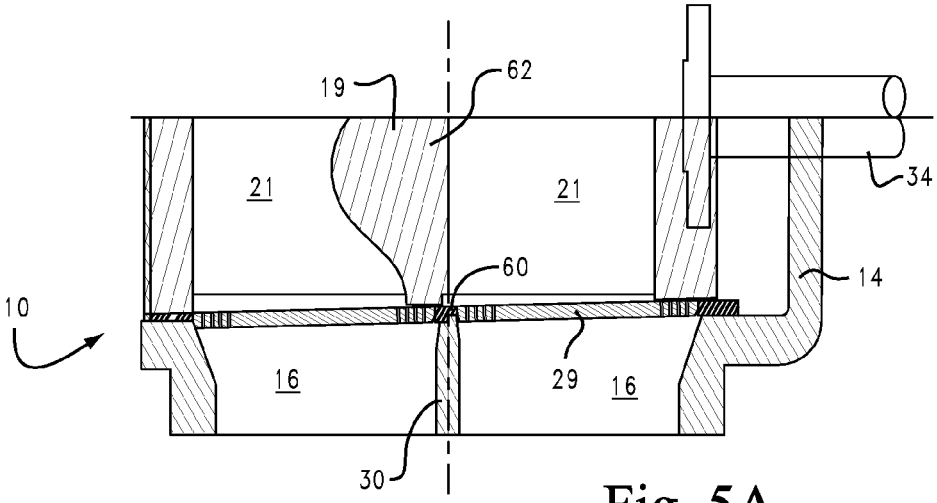
Fig. 5A (Prior Art)
FIGS. 5A and 5B are cross-sectional views of a lower half of a conventional high pressure feeder.
Figure 5B:
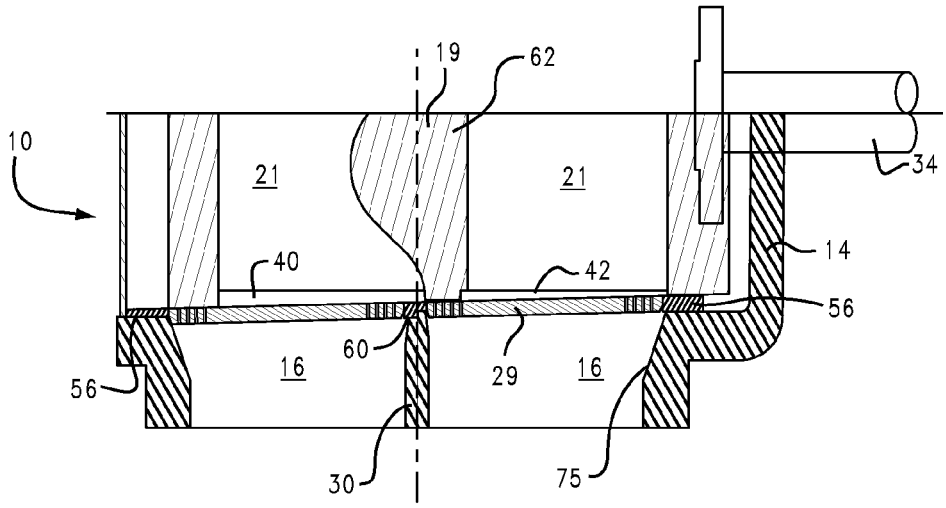
Fig. 5B (Prior Art)

FIGS. 5A and 5B are cross-sectional views of a lower half of a conventional high pressure feeder 10. FIG. 5A shows the shaft 34 and rotor 19 extended to the left in the housing of the feeder. FIG. 5B shows the shaft 34 and rotor 19 extended to the right in the housing of the feeder.

The screen grid 29 shown in FIGS. 5A and 5B is a conventional grid, such as shown in FIG. 4. The grid is seated in the casing 14 of the HPF over the low pressure outlet (third port) 16. The center section 60 of the screen grid abuts the inner end of the divider wall 30. The centers section my have a slot or groove in the outer surface to receive the inner end of the divider wall.

The center section 60 and inner end of the divider wall 30 obstruct a portion of the low pressure outlet 16 of the casing and the ports 40, 42 in the rotor. The amount of obstruction to flow through the low pressure outlet 16 varies depending on the axial position of the rotor in the casing. The center section 60 and divider wall 30 are generally aligned with the circumferential center section 62 of the rotor, especially when the rotor is backed to the left side of the casing as shown in FIG. 5A. The center section 60 and divider wall 30 are less aligned with the circumferential center 62 of the rotor when the rotor is advanced axially towards the right side of the casing, as shown in FIG. 5B.

Figure 6A:
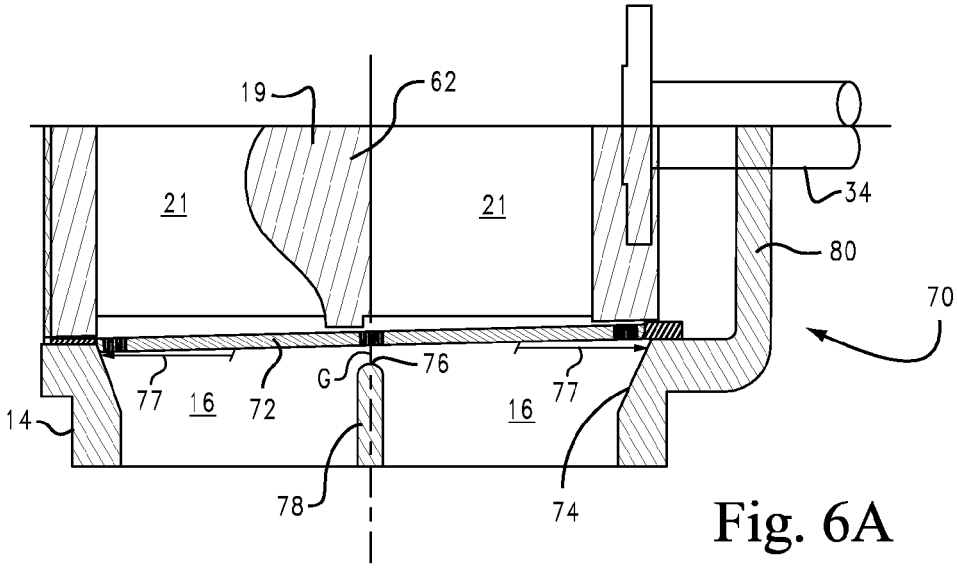
FIGS. 6A and 6B are cross-sectional view of a lower half of high pressure feeder having an expanded low pressure outlet, an elongated screen grid, and a shortened divider wall.
Figure 6B:
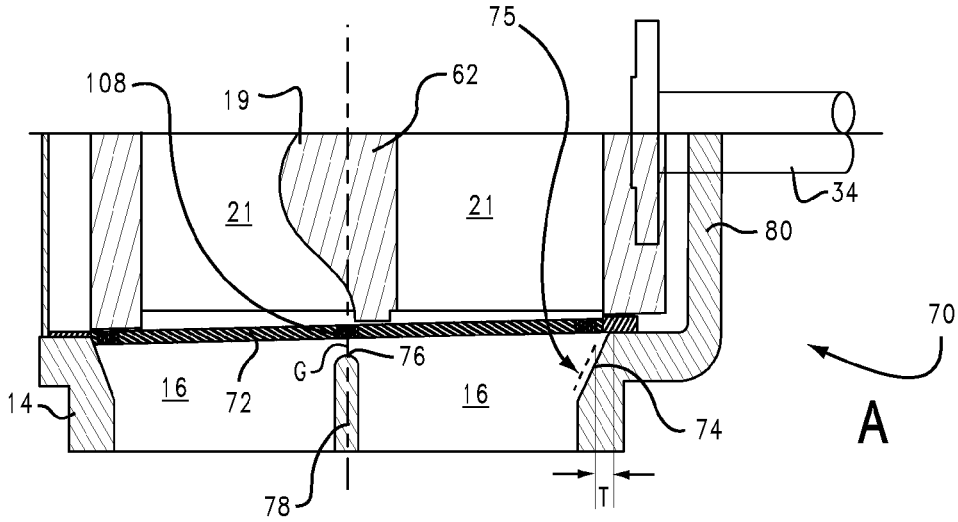

FIGS. 6A and 6B show cross-sectional views of a lower half of a high pressure feeder (HPF) 70. FIG. 6A shows the shaft 34 and rotor 19 extended to the left in the housing of the HPF. FIG. 6B shows the shaft 34 and rotor 19 extended to the right in the housing of the HPF.

The HPF 70 is similar in many respects to the HPF 10. The differences between the two HPFs 10, 70 include that the HPF 70 has a screen grid 72 with wide slots; the slotted region 108 of the screen grid 72 is enlarged and is continuous along the length of the screen grid to conform to the entire area of the enlarged low pressure outlet 16. Further, the wall 74 of the low pressure outlet 16 has been shifted axially outward to expand the open area 77 of the low pressure outlet. The end 76 of the divider wall 78 is set back from the screen grid 72 by a gap (G). In addition, the center circumferential sections 62, 63 of the rotor and liner, respectively, may be narrowed to allow the ports 40, 42 of the rotor and outlets 46 in the liner to be expanded. The center bar in the low pressure outlet of the liner has been eliminated to open the flow area through the liner.

The divider wall 78 in the low pressure outlet does not abut the screen grid 72. A gap (G), e.g., one to two inches (25 mm to 50 mm), between the end 76 of the divider wall and the outer surface of the screen grid 72 allows liquid flowing out of the screen grid to enter the outlet 16 and thereafter pass over the end 76 of the divider wall. In view of the gap (G), the slotted region of the screen grid extends through the mid-section of the screen grid. The screen grid 72 need not have a solid-center section (or a solid region at the junction of two screen grid sections 31).

The inventors recognized that the end of the divider wall need not abut the screen grid. Further, the inventors recognized that providing a gap (G) between the end of the divider wall and the screen grid and providing slots through the center of the screen grid would allow liquid to flow through the center of the screen grid.

The drive end of the casing can be reduced in length to effectively expand the open area of the low pressure outlet 16. In addition, the interior wall 74 of the low pressure outlet 16 may be shifted relative to the corresponding wall 75 of a conventional HPF. For example, the wall 74 of the low pressure outlet is shifted by a distance (T) which may be about an inch (25 mm). The inventors recognized that shifting the wall, e.g., changing the slope of the wall 74, allows more of the grid 72 to pass low pressure liquid flow by aligning with the opening 21 of the rotor.

Figure 7:
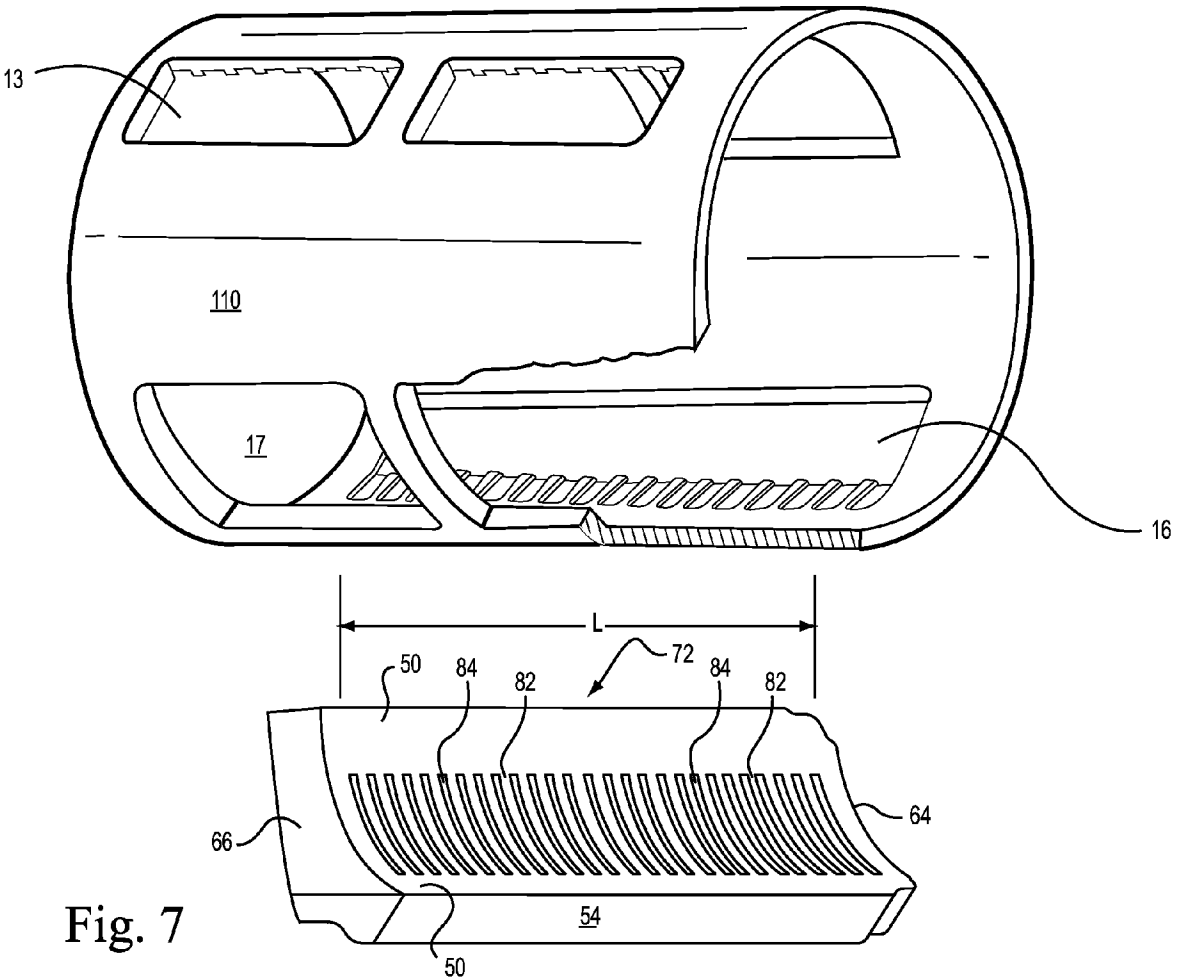
FIG. 7 is a perspective view of a liner and screen grid shown in FIGS. 6A and 6B.

FIG. 7 is a perspective view of a screen grid having bars 82 and slots 84 between the bars. The slots may each form a gap of about 10 mm to 25 mm. Liquid flows through the slots 84 and chips are retained by the bars in the pocket of the rotor. The slots and bars extend substantially the entire length of the screen grid. The width of each of the bars may be larger, e.g., 10 mm to 25 mm, than the width of the slots. A uniform array of parallel slots and bars extends uninterrupted across the portion of the screen grid corresponding to the opening in the low pressure outlet of the HPF. Because of the uniform array, there is no wide solid bar in the center of the screen grid as there is with conventional screen grids.

FIG. 7 shows that the center circumferential bar at the low pressure outlet of the liner 110 may be eliminated. Similarly, a solid center section in the screen grid is unnecessary. The bars 82 may be concave to conform to the cylindrical shape of the rotor. The length (L) of the slotted section of the screen grid 72 covers substantially the entire length of the open area of the low pressure outlet 16 and the ports 42, 44 to the rotor. This length (L) is longer than conventional screen grids, e.g., by about an inch, because of the increased length of the opening in the liner.

Figure 8:
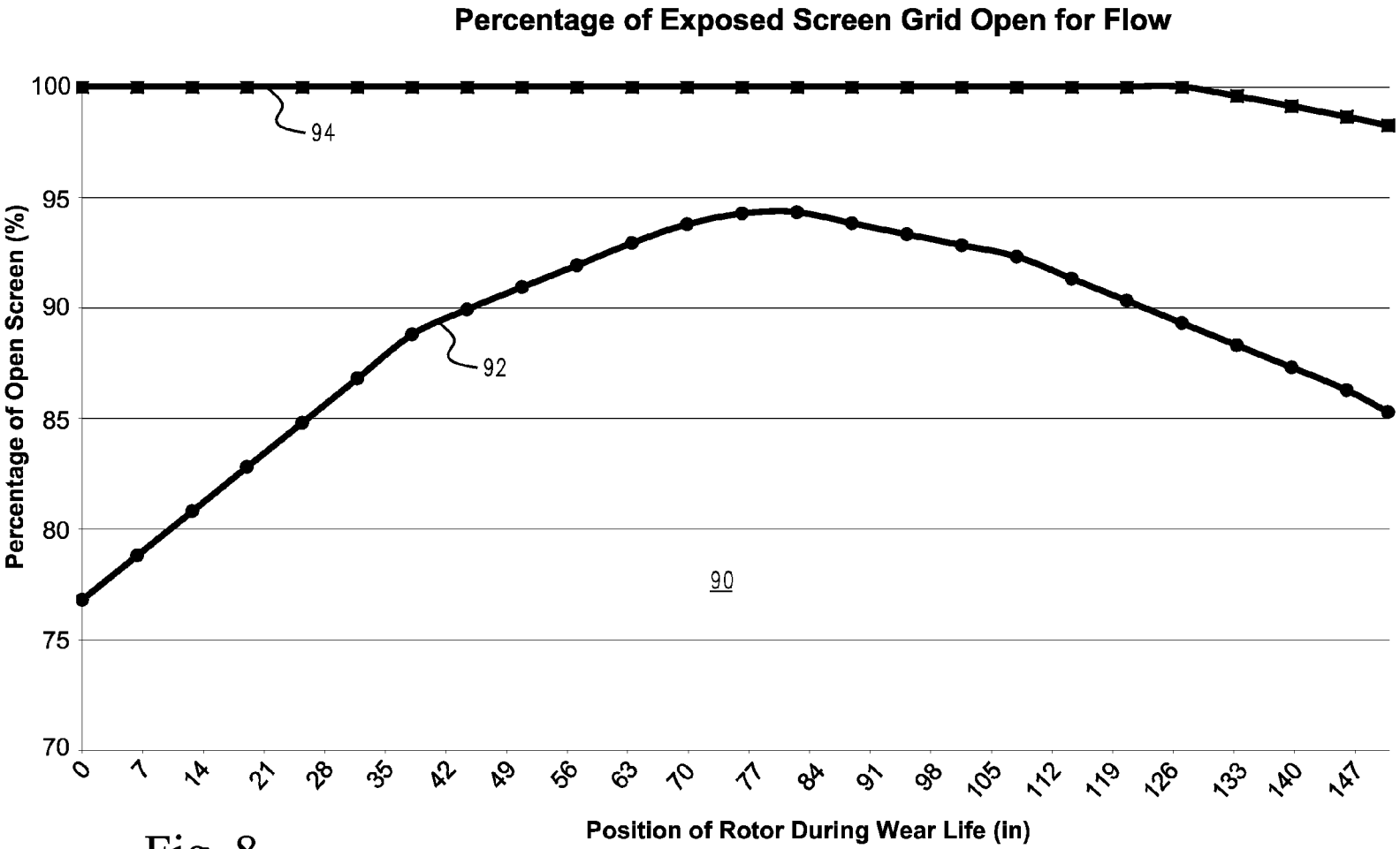
FIG. 8 is a graph of exposed slotted screen area as a function of the axial position of the rotor in the HPF casing for a conventional screen grid and the elongated screen grid.

FIG. 8 is a graph 90 showing the percentage of open screen based on axial rotor position in a casing of a HPF. The curved line 92 represents the percentage of open screen for the conventional HPF 10 and shows the change in this percentage as the rotor is moved axially in the casing. The curved line 94 represents the percentage of open screen for the screen grid 72 in the HPF 70 and shows that the percentage of opening remains very high, e.g., effectively 100 percent, regardless of the axial rotor position.

Specifically, the curved line 92 represents a convention HPF 10 having a screen grid 29 with a nominal slot size of 8 mm, a divider bar abutting a center region of the screen grid, and an elongated drive end of the casing 14. As shown by curved line 92, when the rotor is positioned in the casing as shown in FIG. 5A (which is the rotor position used typically at the beginning of the wear life of the HPF), the efficiency of the screen grid flow is just above 75% due to the number of unobstructed slots in the screen grid and the narrow width of the slots. As the rotor wears, it is advanced axially towards the center of the casing. The advancement of the rotor results in more of the screen slots being available (because of better alignment between the center section of the screen grid and the center of the rotor) so that the flow of liquid is increased through the screen grid and the efficiency increases to almost 95 percent. As the rotor further wears and is advanced axially towards the drive end of the casing, the screen slots again become obstructed and the efficiency falls to about 85 percent.

The uniform and high efficiency represented by straight line 94 is due to the unobstructed slots in the screen grid regardless of the axial position of the rotor, the wider slots in the screen grid, a single and longer screen grid (due to the added length to the screen grid by increasing the length of the liner opening, and a shortened outlet divider bar that does not block a portion of the screen grid.

Some of the features and advantages provided by the HPF 70 include:

A. increased efficiency of liquid flow through the screen grid over the life of the rotor.

B. a slot width in the screen grid of between 10 to 25 mm, which is wider than conventional slots.

C. a shorten outlet divider bar which does not abut the screen grid and thereby allows a larger single screen grid with slots facing the bar being unobstructed by the bar.

D. increase length of openings in the liner to expand the low pressure outlet in the casing and allow for a longer screen grid having a greater slotted area.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A high pressure transfer device comprising adapted for feeding cellulosic fibrous material:

a pocketed rotor containing a plurality of through flow pockets, said rotor rotatable about an axis of rotation and said pockets having opposite end openings which function as both inlets and outlets depending upon an angular position of the rotor within the device, and said pockets are provided in at least first and second sets, wherein the second set of pockets is orthogonal to the first set;

a housing enclosing said rotor, said housing having a low pressure inlet port configured to receive the cellulosic material and the low pressure inlet port is aligned with a low pressure outlet port including an opening, and a high pressure inlet port aligned with a high pressure outlet port wherein the high pressure outlet port is configured to discharge the cellulosic material from the housing, wherein said ports are arranged for registry with the inlets to and outlets from said through going pockets and said rotor being mounted in said housing for rotation with respect to said ports about said given axis of rotation;

a screen grid seated in or adjacent to the low pressure outlet port wherein the screen grid has an array of screen slots and bars wherein a regular pattern of the slots and bars covers entirely the opening in the low pressure outlet port, and a divider wall traverses the low pressure outlet port, wherein the divider wall is separated from the screen grid by a gap.

2. The transfer device in claim 1 wherein the gap is in a range of one to two inches between the outer surface of the screen grid and the inner edge of the divider wall.

3. The transfer device in claim 1 wherein the slots and bars are perpendicular to the axis of the rotor.

4. The transfer device in claim 1 wherein the low pressure outlet port forms an open area of the housing, and the array of screen slots and bars is at least coextensive with the open area.

5. The transfer device in claim 1 wherein the pattern is a uniform pattern of slots and bars extending without interruption across an open region of the low pressure outlet port.

6. The transfer device in claim 1 wherein each slot as a width in a range of 10 mm to 25 mm, and each bar is wider than each slot.

7. The transfer device as in claim 1 further comprising a tapered cylindrical liner in the housing and enclosing the rotor, wherein the liner has a single, uninterrupted low pressure outlet aligned with the screen grid.

8. A rotary high pressure feeder for feeding cellulosic fibrous material comprising:

a rotor rotatable about an axis and comprising at least one pocket comprising a conduit extending through the rotor in a direction perpendicular to the axis and having end openings at opposite ends of the pocket, wherein each of said end openings of each pocket functions as both an inlet and outlet depending upon an angular position of the rotor within a housing;

the housing encloses said rotor and said housing includes a low pressure inlet port adapted to receive a low pressure slurry of the cellulosic fibrous material and a liquid, and a low pressure outlet port radially opposed to the low pressure inlet port and having an opening through which passes low pressure liquid extracted from the low pressure slurry passing through the low pressure inlet, and a high pressure inlet port adapted to receive a liquid flow under high pressure, and a high pressure outlet port aligned horizontally with the high pressure inlet port and adapted to discharge under high pressure the cellulosic fibrous material which passed through the low pressure inlet, wherein the ports are arranged on the housing for registry with the end openings of at least one pocket;

a screen grid seated in or adjacent to the low pressure outlet port, wherein the screen grid includes an array of screen slots and bars to allow passage of the liquid and block passage of the cellulosic fibrous material, wherein the array forms a uniform pattern of slots and bars covering entirely and without interruption the opening in the low pressure outlet port;

a divider wall traverses the low pressure outlet port, and a gap between an inner edge of the divider wall and an outer surface of the screen grid, wherein the gap is in a direction of the low pressure liquid passing through the low pressure outlet port.

9. The rotary high pressure feeder in claim 8 wherein the slots and bars are perpendicular to the axis of the rotor.

10. The rotary high pressure feeder in claim 8 wherein each slot as a width in a range of 10 mm to 25 mm.

11. The rotary high pressure feeder as in claim 8 further comprising a tapered cylindrical liner in the housing and enclosing the rotor, wherein the liner has a single, uninterrupted low pressure outlet aligned with the screen grid.

12. The rotary high pressure feed in claim 8 wherein the low pressure outlet port has an open area and the array of screen slots and bars is at least coextensive with the open area.

13. The rotary high pressure feeder in claim 8 wherein the gap is in a range of one to two inches between the outer surface of the screen grid and the inner edge of the divider wall.

14. A rotary high pressure feeder for feeding cellulosic fibrous material comprising:

a rotor rotatable about an axis and comprising at least one pocket comprising a conduit extending through the rotor in a direction perpendicular to the axis and having end openings at opposite ends of the pocket, wherein each of said end openings of each pocket functions as both an inlet and outlet depending upon an angular position of the rotor within a housing;

the housing encloses said rotor and said housing includes a low pressure inlet port adapted to receive a low pressure slurry of the cellulosic fibrous material and a liquid, and a low pressure outlet port aligned radially opposed to the low pressure inlet port and having an opening; through which flows low pressure liquid extracted from the low pressure slurry passing through the low pressure inlet, and a high pressure inlet port adapted to receive a liquid flow under high pressure, and a high pressure outlet port aligned horizontally with the high pressure inlet port and adapted to discharge under high pressure the cellulosic fibrous material which passed through the low pressure inlet, wherein the ports are arranged on the housing for registry with the end openings of at least one pocket;

a screen grid seated in or adjacent to the low pressure outlet port, wherein the screen grid includes an array of screen slots and bars to allow passage of the liquid and block passage of the cellulosic fibrous material, wherein a regular pattern of the slots and bars covers entirely the opening in the low pressure outlet port; and a gap between the screen grid and an edge of a divider wall in the housing and traversing the low pressure outlet port, wherein liquid flowing through the slots passes through the gap.

15. The rotary high pressure feeder in claim 14 wherein the slots and bars are perpendicular to the axis of the rotor, and the divider wall is perpendicular to the axis of the rotor.

16. The rotary high pressure feeder in claim 14 wherein the gap is in a range of one to two inches.

17. The rotary high pressure feeder in claim 14 wherein the gap is between an outer surface of the screen grid and the edge of the divider wall.

18. The rotary high pressure feeder in claim 14 further comprising a tapered cylindrical liner in the housing and enclosing the rotor, wherein the liner has a single, uninterrupted low pressure outlet aligned with the screen grid.

* * * * *